US006522226B2

(12) United States Patent
Crouch et al.

(10) Patent No.: US 6,522,226 B2
(45) Date of Patent: Feb. 18, 2003

(54) TRANSPARENT METALLIC MILLIMETER-WAVE WINDOW

(75) Inventors: David D. Crouch, Corona, CA (US); Kenneth W. Brown, Yucaipa, CA (US); William E. Dolash, Monclair, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/892,093

(22) Filed: Jun. 26, 2001

(65) Prior Publication Data

US 2003/0001699 A1 Jan. 2, 2003

(51) Int. Cl.[7] ..... H01P 1/08
(52) U.S. Cl. ..... 333/252; 333/251
(58) Field of Search ..... 333/252, 251

(56) References Cited

U.S. PATENT DOCUMENTS 3,675,165 A * 7/1972 Ueda et al. ..... 333/98 P
5,038,712 A * 8/1991 Fujiyama ..... 118/723
5,548,257 A * 8/1996 Caplan et al. ..... 333/252
5,936,493 A * 8/1999 Hulderman et al. ..... 333/252

OTHER PUBLICATIONS

J.F. Gittens, "Power Travelling–Wave Tubes", American Elsevier Publishing, New York, NY, pp. 236–237 (1965).
C.C. Chen, "Transmission through a conducting screen perforated periodically with apertures", IEEE Microwave Theory Tech., vol. MTT–18, No. 9, pp. 627–632 (Sep. 1970).

* cited by examiner

*Primary Examiner*—Michael Tokar
*Assistant Examiner*—Vibol Tan
(74) *Attorney, Agent, or Firm*—Colin M. Raufer; Leonard A. Alkov; Glenn H. Lenzen, Jr.

(57) ABSTRACT

A millimeter-wave window is constructed from a high conductivity metal plate. The metallic plate is made transparent over a range of frequencies by perforating it with a periodic array of slots. In one embodiment, the millimeter-wave window is used in a gyrotron as the output window. In such a case, one suitable periodic array of slots comprises an equilateral triangular array of slots for operation at 95 GHz. By proper choice of the hole spacing and diameter, the window can be made transparent at any desired frequency. In addition to being transparent, however, the window must also be vacuum tight, as the pressure inside a gyrotron is on the order of $10^{-9}$ torr. The present invention solves this problem by covering the surface of the window with a thin layer of a suitable dielectric material, such as fused quartz.

17 Claims, 7 Drawing Sheets

TRANSPARENT METALLIC MILLIMETER-WAVE WINDOW

TECHNICAL FIELD

The present invention is related generally to microwave systems, and, more particularly, to transparent high-power windows used in the millimeter region.

BACKGROUND ART

Microwave systems often require windows that are transparent at the frequencies of interest. This problem is particularly acute at millimeter-wave frequencies, where most dielectric materials tend to have high loss tangents. At low power levels, a high loss tangent may be acceptable, as long as the window is thin enough to prevent more than a small fraction of the incident power from being absorbed. At high power levels, a window made from a material having a high loss tangent will become extremely hot and may fail if not actively cooled. Such windows are usually cooled at their edges, since most coolants themselves have high loss tangents and therefore cannot be directly exposed to millimeter-wave power. The need therefore exists for a microwave window capable of reliably transmitting extremely high levels of millimeter-wave power.

Surface-cooled double-disk windows made from sapphire have been used as the output windows for high-power gyrotrons. These windows are cooled by a special coolant having a low loss tangent at millimeter-wave frequencies. The coolant flows in the gap between the two disks. While double-disk windows improve upon the performance of single-disk edge-cooled windows, their thermal performance is insufficient to allow megawatt-class gyrotrons designed for CW operation to operate for more than a few seconds at a time.

Recently, synthetic diamond disks of sufficient size and quality for use as gyrotron output windows have become available. Diamond is a nearly ideal material for use as a dielectric window, as the loss tangent of high-quality material is very low at millimeter-wave frequencies ($<5\times10^{-5}$) and its thermal conductivity is twice that of copper. However, because a disk of sufficient size and thickness for a gyrotron window takes several weeks to grow, and because there are few sources for such disks, diamond windows are very expensive.

Thus, there remains a need for transparent windows at millimeter frequencies that avoid most, if not all, of the problems described above.

DISCLOSURE OF INVENTION

In accordance with the present invention, a millimeter-wave window is constructed from a high conductivity metal such as copper, beryllium copper, or aluminum. The metallic plate is made transparent over a range of frequencies by perforating it with a periodic array of slots, or openings.

In one embodiment, the millimeter-wave window of the present invention is used as the output window in a gyrotron. In such a case, one suitable periodic array of slots, or holes, comprises an equilateral triangular array of slots. By proper choice of the hole spacing and diameter, the window can be made transparent at any desired frequency.

In addition to being transparent, however, the output window must also be vacuum tight, as the pressure inside a gyrotron must be maintained at a level on the order of $10^{-9}$ torr. The present invention solves this problem by covering the surface of the high-pressure side of the window with a thin layer of a suitable dielectric material. A suitable dielectric will have a low loss tangent and a low coefficient of thermal expansion. In addition, if the dielectric is to be used in a high-vacuum environment, it must be of a material that does not continuously evolve gasses from its surface (ruling out the use of most polymers and organic-based materials). Materials suitable for use in a high-vacuum environment include alumina, fused quartz, sapphire, and CVD diamond. For applications in which the window must provide an air-tight seal but is not required to maintain a high vacuum, the last requirement on the window material can be relaxed. Because the dielectric is in intimate contact with the perforated metal plate, any heat generated in the dielectric layer has only to diffuse to the dielectric-metal boundary, where it is quickly carried away by conduction in the much higher conductivity metal. As a result, the dielectric need not have a high thermal conductivity. For most applications, edge cooling of the metal-dielectric window should provide sufficient cooling. For very high-power applications where edge cooling may be inadequate, cooling channels may be incorporated directly into the interior of the perforated metal plate, which will allow the window to transmit more power than its edge-cooled counterpart.

The novel features of the present invention are its use of a periodic metal structure as a high-power microwave window. Metal structures have been used in windows before, but usually in such a way so as not to interfere with the transmission of microwave energy; this is typically done by placing thin metal ribs perpendicular to the incident electric field. The present invention takes a different approach by making a metal structure an integral part of the window, one that strongly interacts with the incident microwave fields. This approach toward window design is considered to be novel and unique.

BEST MODES FOR CARRYING OUT THE INVENTION

In accordance with the present invention, a transparent metallic millimeter-wave window is provided. The window is constructed from a high conductivity metal, such as copper. One can make a metallic plate transparent over a range of frequencies by perforating it with a periodic array of slots. For the output window of a gyrotron, one might choose an equilateral triangular array of circular holes. By proper choice of the hole spacing and diameter, the window can be made transparent at any desired frequency.

Figure 1:
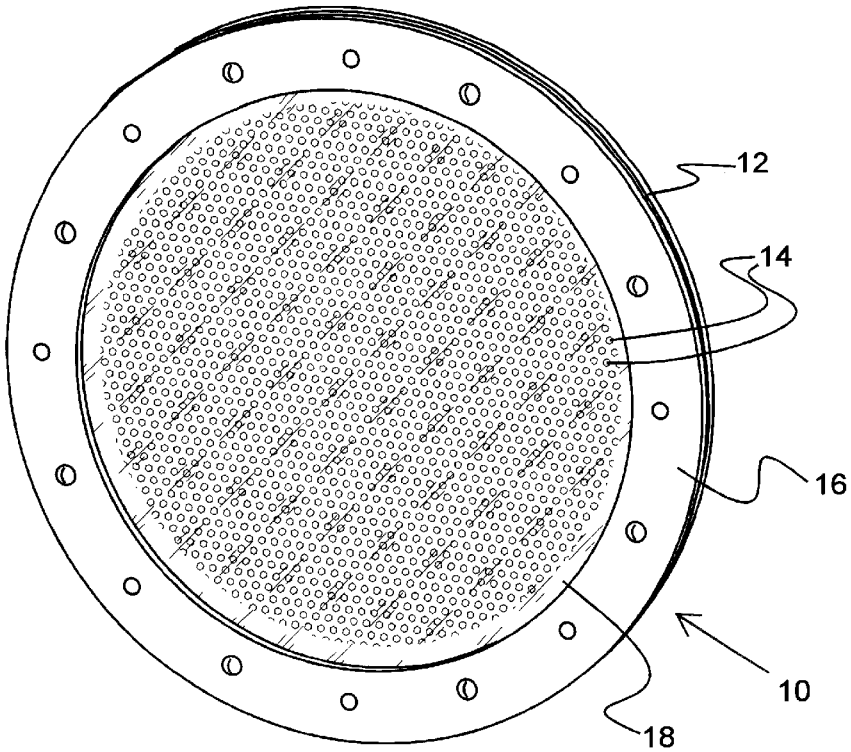
FIG. 1 is a perspective view of the millimeter-wave window of the present invention.

In particular, the present invention is a dielectric-covered metallic window that is transparent at millimeter-wave frequencies. The window is constructed from a metal plate perforated by a periodic array of holes and covered by a thin dielectric plate. The diameter of the holes and the periodicity of the array are chosen to minimize the power reflected at the design frequency. A window constructed to demonstrate the concept is shown in FIG. 1. The window 10 comprises a metal plate 12, provided with a plurality of holes, or slots, 14. The holes 14 may be circular or other, non-circular shape, depending on the particular design needs. The metal plate 12 comprises a high conductivity metal, such as copper, beryllium-copper alloy, or aluminum. The array can be triangular, preferably isosceles triangle or equilateral triangle, or other periodic array. Further, the array can be totally periodic across the metal plate 12 or of varying periodicity, depending on the particular design needs.

Figure 2:
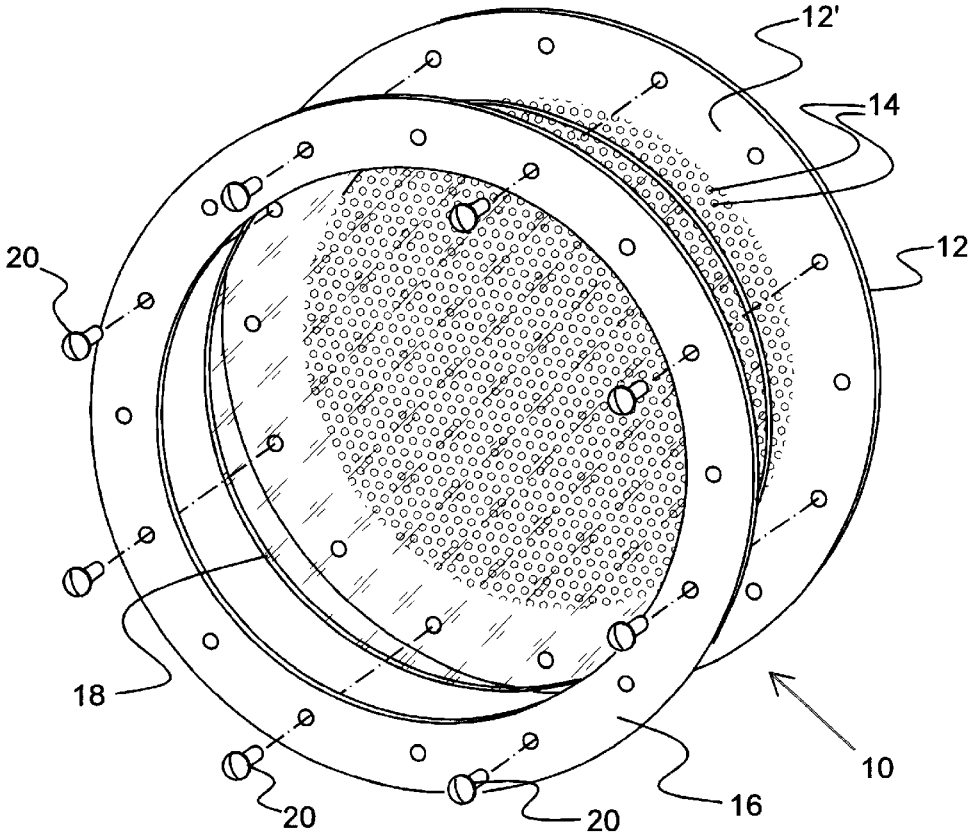
FIG. 2 is an exploded view of the millimeter-wave window shown in FIG. 1.

The individual components are shown in FIG. 2. Specifically, a retainer ring 16 holds a dielectric plate 18 against the perforated metal plate 12. The retainer ring 16 is secured to a like retainer ring 12' on the periphery of the perforated metal plate 12 by a plurality of spaced fasteners, such as screws 19. The dielectric plate comprises a dielectric material such as fused quartz, alumina, sapphire, or chemically-vapor-deposited (CVD) diamond.

Such a window 10 is expected to prove particularly useful at millimeter-wave frequencies, where most dielectric materials are poorly suited for use as windows due to their high loss tangents and poor thermal conductivity.

As an example, high-power millimeter-wave gyrotrons have been built with output powers of up to 1 MW at frequencies up to 140 GHz. At megawatt power levels, the pulse length has been limited only by the lack of a material for the output window capable of transmitting the power without overheating. Gyrotron output windows have traditionally been constructed from sapphire, and more recently from CVD diamond. CVD diamond is an excellent material from which to construct gyrotron output windows, as it has a low loss tangent, excellent mechanical properties, and a thermal conductivity more than twice that of copper. Unfortunately, it is difficult to grow and is available only from a few sources, which makes it very expensive.

The present invention provides a high-performance low-cost alternative to diamond for gyrotron output window and for other applications. While the thermal conductivity of the dielectric plate 18 is far less than that of diamond, any heat generated in the dielectric has only to flow into the perforated metallic plate 12, from which it is rapidly conducted to the cooling channels (not shown) at the edge of the plate. While the perforated metallic plate 12 has a thermal conductivity which is less than half that of diamond, the overall thermal conductance of the window 10 is determined not only by the thermal conductivity of the material from which it is constructed, but also by its thickness. In general, for a given window material and thickness, the thermal conductance is proportional to the product of the thermal conductivity of the window material and its thickness, so that increasing the window thickness by a factor of two will increase its thermal conductance by the same factor. In order to minimize reflections, the thickness of a purely dielectric window is typically chosen to bc an odd multiple of $\lambda/2$ (where $\lambda$ is the wavelength inside the material). At 95 GHz, a $\lambda/2$ diamond window will be 26 mils thick, and a $3\lambda/2$ diamond window will be 81 mils thick (and will cost significantly more than a $\lambda/2$ diamond window). The present invention does not suffer from this constraint on the thickness. Any convenient value can be chosen for the thickness of the window 10; once the thickness of the underlying metallic plate 12 and the dielectric cover 18 have been chosen, the hole pattern and diameter can be chosen to make the window transparent at the desired operating frequency. For the prototype window 10 illustrated in FIGS. 1 and 2, the perforated metallic plate 12 is 250 mils thick, almost 10 times that of a $\lambda/2$ diamond window. Assuming that the thermal conductivity of diamond is twice that of the metallic plate 12, the prototype metallic window 10 will have a thermal conductance approximately 5 times that of a $\lambda/2$ diamond window. In summary, then, the thermal performance of the transparent metallic window 10 of the present invention can be equivalent or superior to that of a diamond window at a fraction of the cost.

In FIG. 1, the dielectric plate 18 is held in place against the perforated metal plate 12 by the retainer ring 16. For many applications, the seal that a window of this type provides is adequate. However, for applications in which one side of the window must be maintained at a very low pressure (e.g., the interior of a gyrotron where the pressure must be maintained at approximately $10^{-9}$ torr), a different method of construction is required. Since many ceramics (alumina, diamond, and sapphire, for example) can be metallized for brazing to copper, dielectric plates 18 made from these materials can be brazed directly to a copper window structure, providing a much better vacuum seal than is possible using a retainer ring 16. Such a seal can be ensured by adapting conventional techniques that have been developed for constructing ceramic-to-metal seals for use with the present invention.

Figure 3:
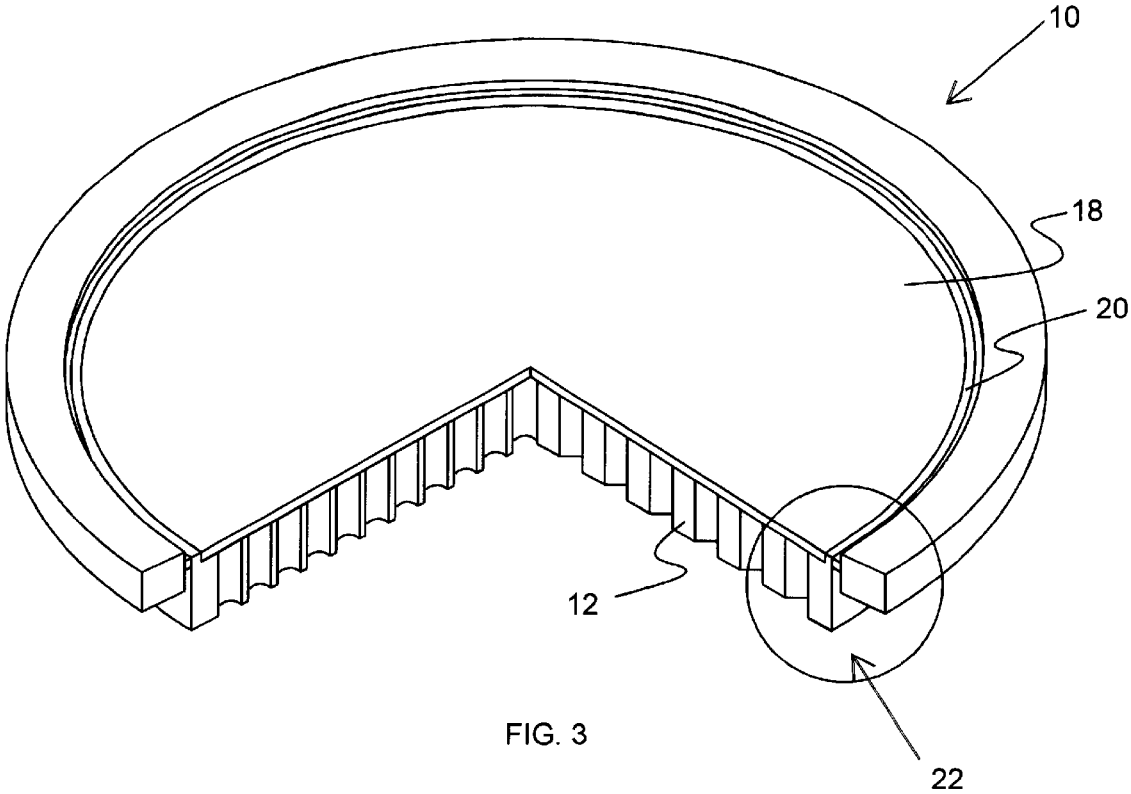
FIG. 3 is a cutaway view of the millimeter-wave window shown in FIGS. 1 and 2 with a ceramic-to-metal vacuum seal for use in high-vacuum applications.
Figure 3A:
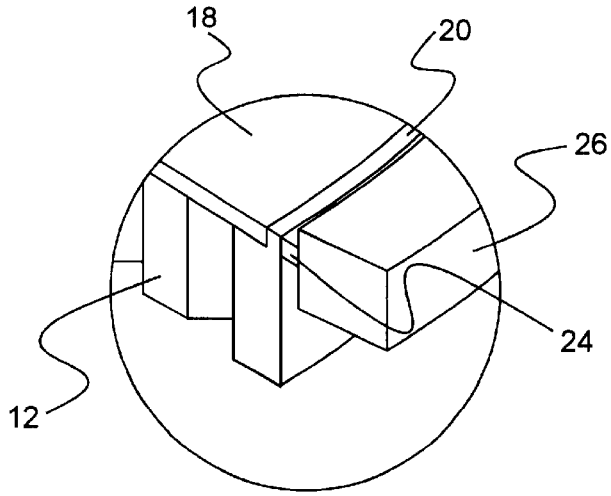
FIG. 3*a* is an enlargement of a portion of FIG. 3.

One possible realization of a ceramic-to-metal vacuum seal in which the conventional techniques of vacuum window construction have been applied to the present invention is shown in FIGS. 3–3*a;* see, e.g., J. F. Gittens, *Power Travelling-Wave Tubes,* pp. 236–237, American Elsevier Publishing, New York, N.Y. (1965). In keeping with conventional practice in the microwave tube industry, the metallic plate 12 is preferably copper. The plate 12 incorporates a thin-walled copper tube 20 to which the ceramic plate 18 is brazed. A double "corset" 22 consisting of an inner ring 24 of molybdenum and an outer ring 26 of mild steel ensures that the ceramic-to-metal seal is held in slight compression at all temperatures. Only the molybdenum ring 24 is in place during the first heating to braze; it is designed to achieve a close fit around the thin-walled copper tube 20 at room temperature. Due to its lower thermal expansion coefficient, the molybdenum ring 24 will expand more slowly than the thin-walled copper tube 20, thus maintaining intimate contact between the copper tube and the ceramic plate 18 during and after the brazing process. The outer mild steel ring 26 is made to be a close fit at the brazing temperature, so that its inside diameter is slightly smaller than the outer diameter of the molybdenum ring 24 at room temperature; it is dropped into place at the brazing temperature. As it cools, the outer steel ring 26 contracts, placing the ceramic-to-metal seal into a controlled amount of compression; this ensures that the brazed joints are subjected to neither tension nor sheer at any time, making it possible for them to survive repeated temperature cycling.

Figure 4:
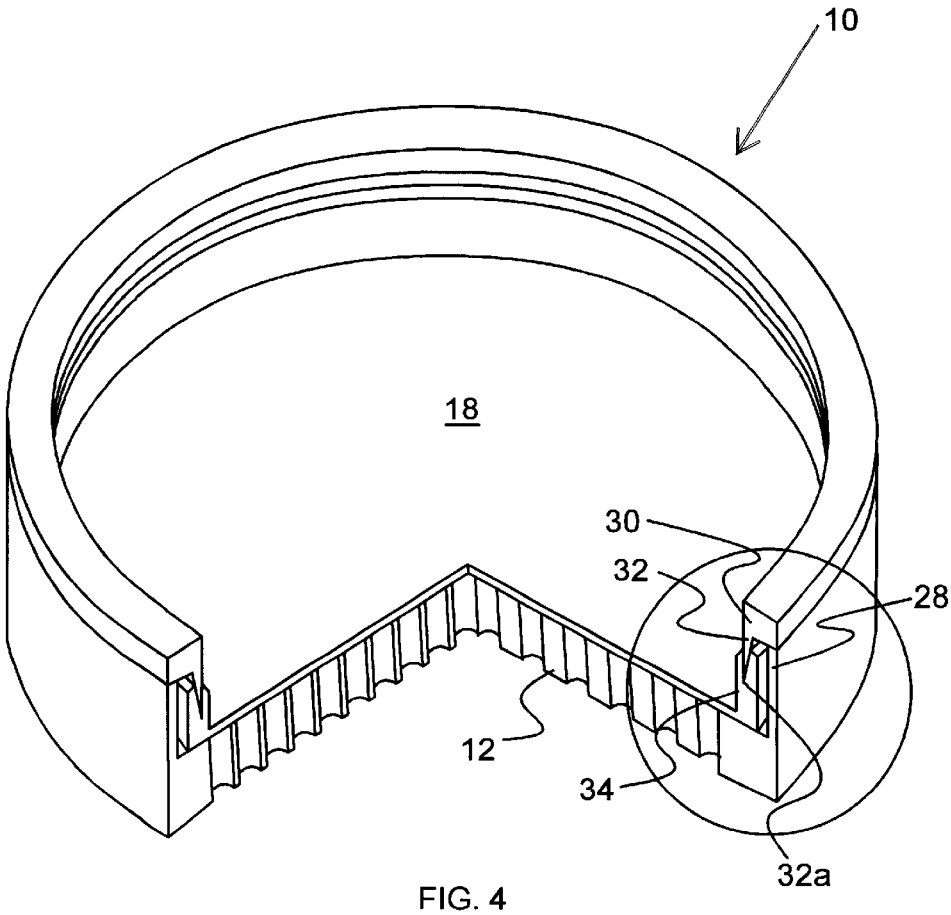
FIG. 4 is a cutaway view of the millimeter-wave window shown in FIGS. 1 and 2 with a fused quartz-to-molybdenum vacuum seal for use in high-vacuum applications.
Figure 4A:
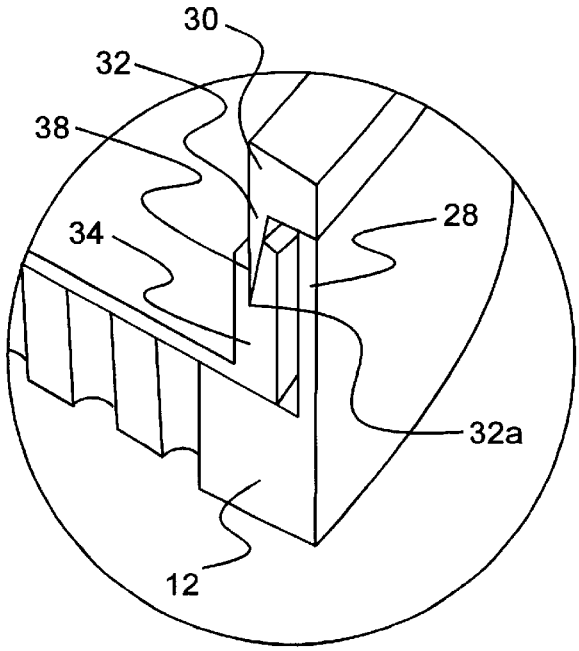
FIG. 4*a* is an enlargement of a portion of FIG. 4.

An even simpler procedure can be used to construct a high-quality vacuum seal if the dielectric plate material 18 is fused quartz; FIGS. 4–4*a* show one possible realization of such a seal. The window assembly 10 consists of the perforated copper plate 12 provided with a raised rim 28 that supports a molybdenum ring 30. The molybdenum ring includes a raised inner rim 32 that extends towards the surface of the perforated copper plate 12 and terminates in a knife edge 32*a* that is embedded in a raised rim 34, forming what is known as a Housekeeper's seal 38. The plate 18 and the raised lip, or rim, 34 define a quartz "cup". No specific mechanism is included in this design to guarantee intimate contact between the quartz cup and the perforated copper plate 12; such contact will be ensured by the force exerted by atmospheric pressure on the quartz cup.

In its best mode for high-vacuum applications, then, a vacuum seal is provided between the dielectric plate 18 and the metal plate 12. Those skilled in the art will appreciate that the present teachings are not limited to the manner in which the vacuum seals are constructed in FIGS. 3–3*a* and 4–4*a*.

The predicted performance of the window 10 was calculated by approximating the finite array of holes 14 with an infinite array illuminated by a plane wave. The periodicity of the structure and the plane-wave excitation allow approximation of the reflected and transmitted fields by an expansion in terms of a finite number of discrete plane waves (Floquet modes), while the fields in the circular holes 14 are expanded in terms of a finite number of circular waveguide modes. By imposing continuity on the tangential electric and magnetic fields at the two surfaces of the array, a matrix equation is obtained for the unknown waveguide mode coefficients. The amplitudes of the reflected and transmitted Floquet modes are then derived from the solution to this matrix equation. The computational method employed herein is based, e.g., on C. C. Chen, "Transmission through a conducting screen perforated periodically with apertures", *IEEE Microwave Theory Tech.,* Vol. MTT-18, no. 9, pp. 627–632, (September 1970).

Figure 5:
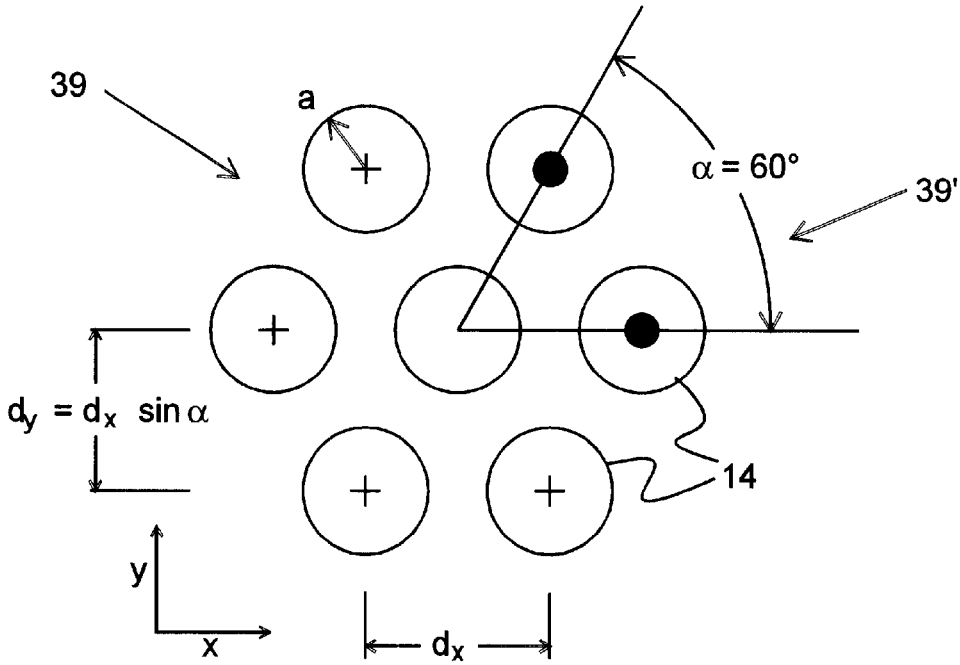
FIG. 5 is a schematic diagram depicting the parameters involved in determining the diameter of the holes and the periodicity of the array to provide the operating frequency of the window.

The operating frequency of the window 10 is determined by the diameter of the holes 14, the periodicity of the array 39, and the thickness of the plate 12. The operating frequency of the window 10 shown in FIGS. 1 and 2 is 95 GHz. To avoid scattering energy into directions other than normal to the window surfaces, the periodicity of the array 39 must be such that grating lobes cannot exist. If the holes 14 are arranged in an isosceles triangular array 39' such as that shown in FIG. 5, then it can be shown that no grating lobes can exist if the following conditions are satisfied:

$$2\frac{\lambda}{d_x} \geq 1+\sin\theta,\ \frac{\lambda}{d_y} \geq 1+\sin\theta,$$

$$\left(\frac{\lambda}{d_x}\right)^2+\left(\frac{\lambda}{2d_y}\right)^2 \geq (1+\sin\theta)^2,$$

where θ is the angle of incidence of the incident field with respect to the direction normal to the surface of the window. The window 10 is designed for use at normal incidence for which θ=0. Those skilled in the art will appreciate that the present invention is not limited to normal incidence, and that other angles of incidence are possible.

The window 10 shown in FIGS. 1 and 2 has the following dimensions:

2*a*=hole diameter=103±0.25 mils

α=hole offset angle=60°

$d_x$=horizontal hole spacing=123.5±0.5 mils $d_y$=vertical hole spacing=$d_x$ sin α=107.0±0.5 mils D=plate thickness=250±0.5 mils L=dielectric thickness=36±0.25 mils $\in_r$=dielectric constant=3.827 (Corning 7940 fused silica at 95 GHz).

Substitution of $d_x$, $d_y$ (for α=60°), and λ=124.2 mils (at 95 GHz) for θ=0 shows that all three conditions are satisfied, so that grating lobes cannot exist for this design. If operation at other than normal incidence is desired, i.e., if θ≠0, then the hole spacings $d_x$ and $d_y$ are subject to the aforementioned constraints that prevent the existence of grating lobes at the desired value of θ. Within these constraints, one must choose the hole diameter 2*a,* the plate thickness D, and, for a given dielectric material, the dielectric thickness L to provide transparency at the desired operating frequency.

Figure 6:
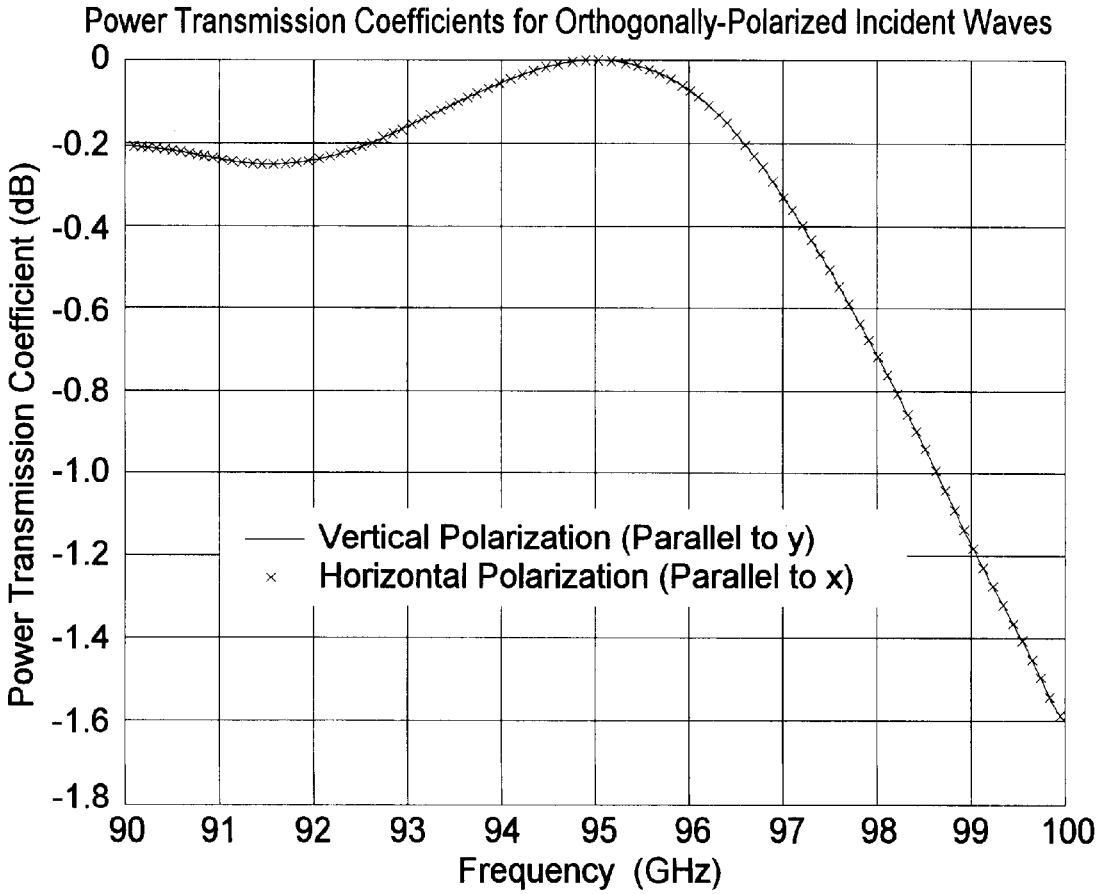
FIG. 6, on coordinates of power transmission coefficient (in dB) and frequency (in GHz), is a plot of the calculated power transmission coefficients for orthogonally-polarized incident waves as functions of frequency for a dielectric-covered window prototype.
Figure 7:
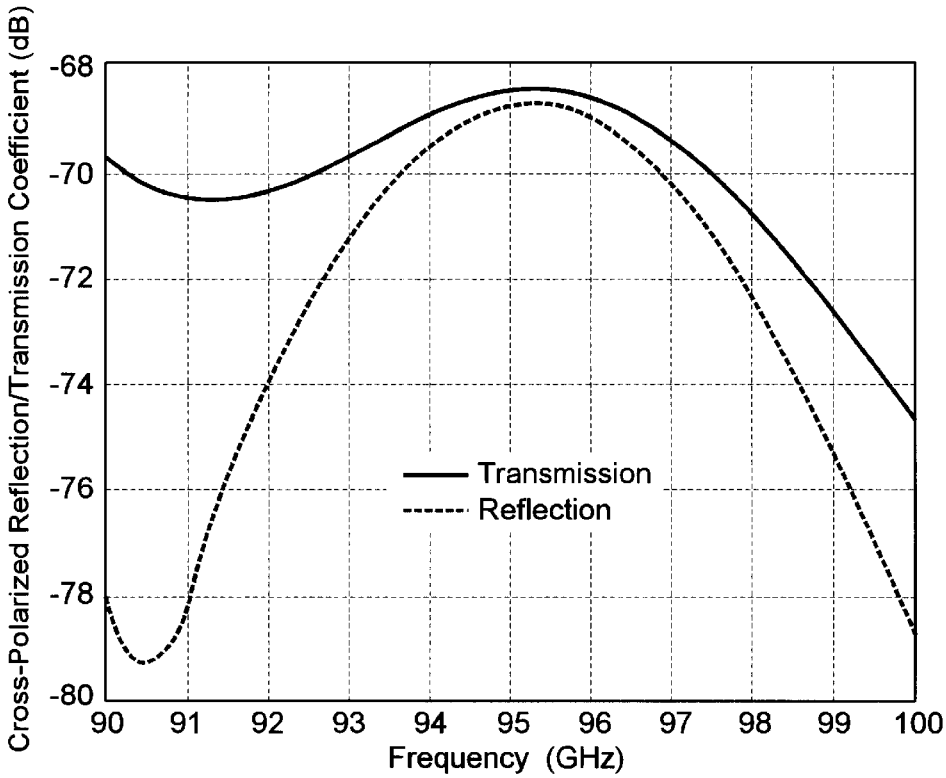
FIG. 7, on coordinates of reflection and transmission coefficient (in dB) and frequency (in GHz), is a plot of the cross-polarized reflection and transmission coefficients as functions of frequency.
Figure 8:
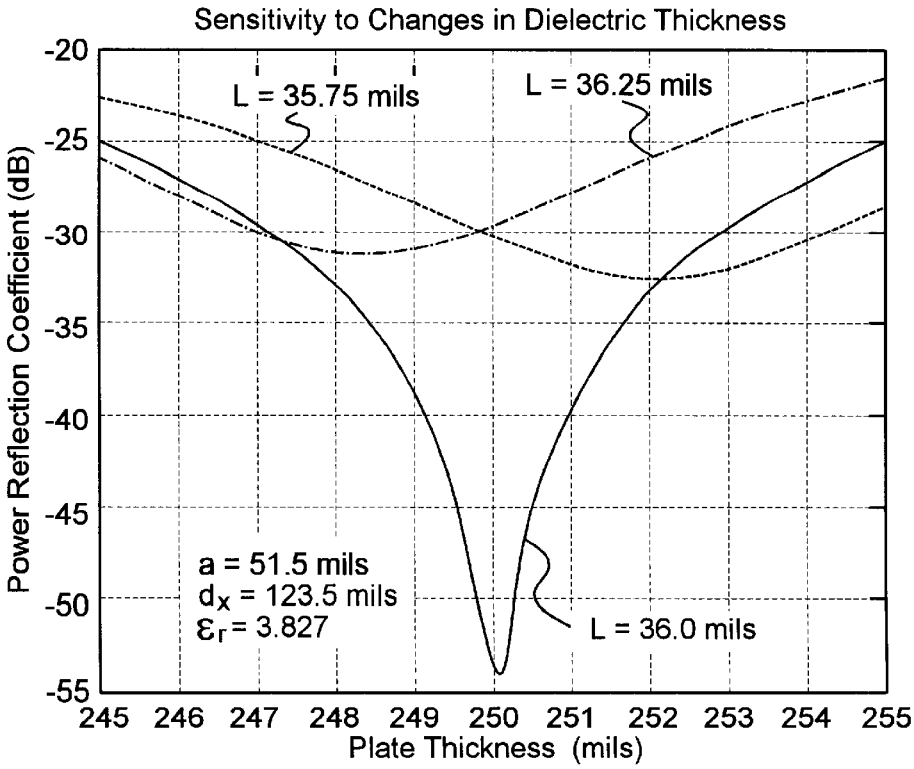
FIG. 8, on coordinates of power reflection coefficient (in dB) and plate thickness (in mils), is a plot of the sensitivity to changes in dielectric thickness.

The predicted performance of the window 10 is shown in FIGS. 6, 7, and 8. FIG. 6 shows the power transmission coefficient as a function of frequency for both vertically and horizontally polarized incident waves. Since any incident wave can be decomposed into vertically and horizontally-polarized components, this Figure indicates that the window will transmit nearly 100% of the incident power at the design frequency of 95 GHz independent of the polarization of the incident field. Losses in the conductor 12 and the dielectric 18 will, of course, result in a finite loss; these results indicate that such losses should be quite low. In addition, the calculations predict that the window 10 will have a reasonable bandwidth.

Periodic structures often have the undesired effect of producing cross-polarized reflected and transmitted field components, i.e., electric field components orthogonal to that of the incident field. FIG. 7 shows that not to be the case with the window 10 of the present invention. FIG. 7 shows the cross-polarized power reflection and transmission coefficients as functions of frequency. As both the reflection and transmission coefficients are less than −68 dB across the entire band of interest, almost none of the incident wave is converted into cross-polarized reflected or transmitted components.

The sensitivity of the window performance to the various dimensions was examined in detail. The tolerances given above for the dimensions of the perforated metallic plate 12 were derived based on these calculations. Moreover, past experience with structures of this type (without dielectric covers) indicates that the metallic plate 12 should yield the desired performance if it conforms to the given tolerances. The window's performance is most sensitive to the thickness of the dielectric plate 18, as shown in FIG. 8. In this example, the dielectric plate 18 is made from Corning 7940 fused silica, whose dielectric constant is 3.827 at 95 GHz. Note that this material is not suitable for use in a high-vacuum environment, as fused silica is porous and cannot provide a vacuum seal. This material was used in constructing the prototype window because it is inexpensive and because its dielectric constant and loss tangent at 95 GHz are known.

As shown in FIG. 8, the power reflection coefficient increases from nearly −55 dB when L=36 mils to less than −30 dB when L=35.75 mils or L=36.25 mils, which is still acceptable for most applications (including use as an output window for a high-power gyrotron).

Figure 9:
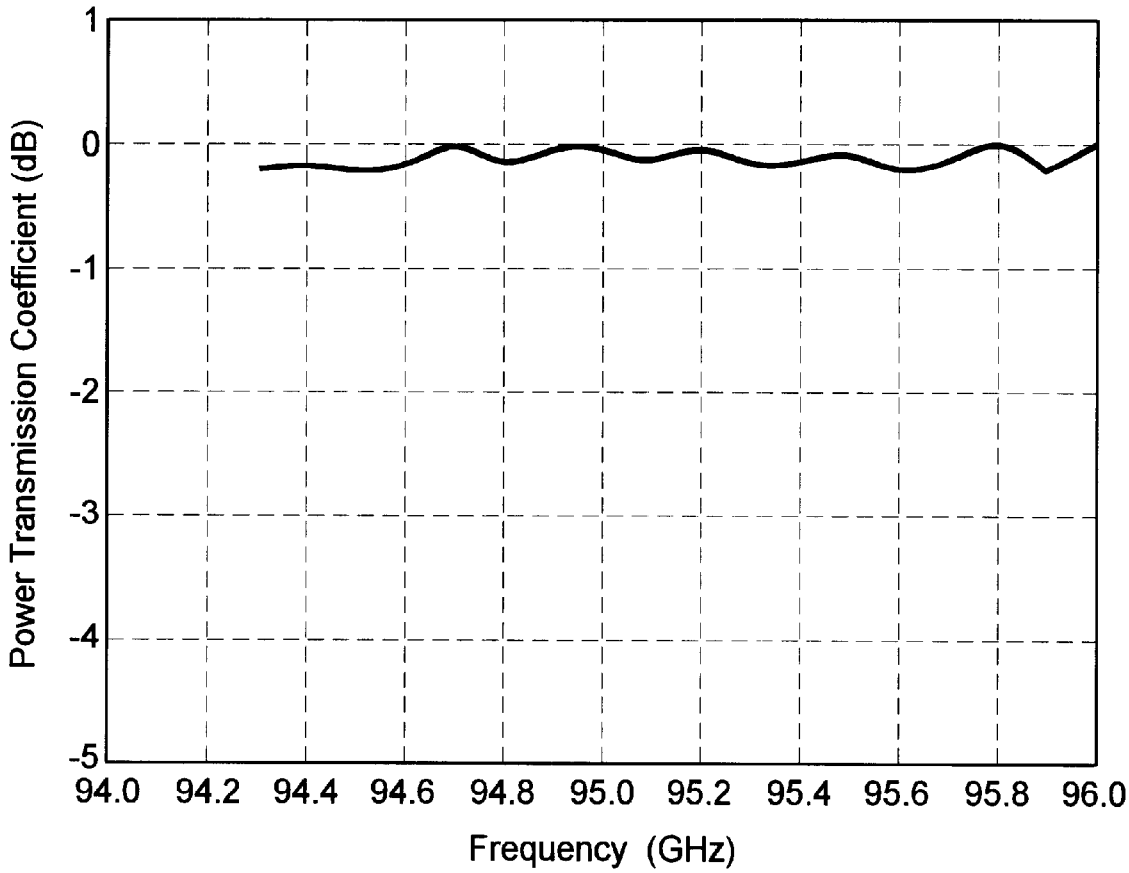
FIG. 9, on coordinates of power transmission coefficient (in dB) and frequency (in GHz), is a plot of the measured power transmission coefficient as a function of frequency for a dielectric-covered window prototype.

The performance of the transparent millimeter-wave window 10 was tested by illuminating it with a Gaussian millimeter-wave beam generated by a lens antenna. The window 10 was placed at the waist of the Gaussian beam, and a second lens antenna was used to receive the transmitted beam. Measured values of the power transmission coefficient are plotted as a function of frequency in FIG. 9. The power transmission coefficient is essentially flat over the range of frequencies shown, and is less than 0.1 dB at the design frequency of 95 GHz, so that more than 98% of the incident power is transmitted by the window 10.

Figure 11:
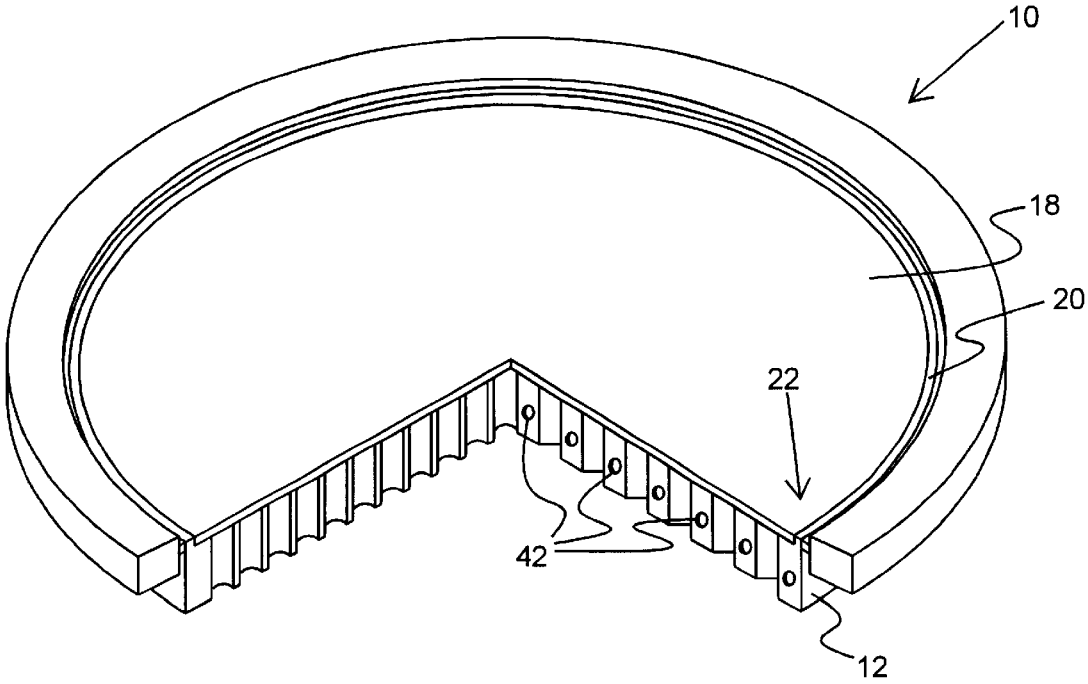
FIG. 11 depicts an alternate embodiment of cooling the millimeter-wave window, employing cooling channels incorporated into the interior of the window.
Figure 10:
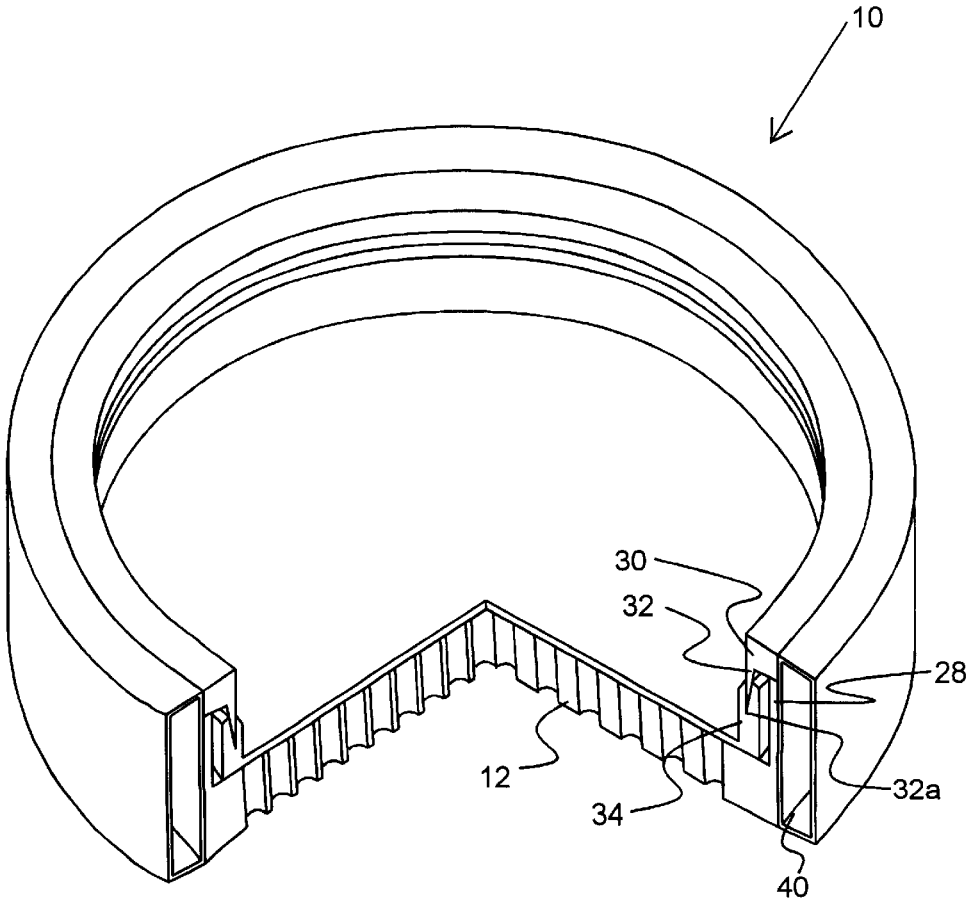
FIG. 10 depicts cooling of the millimeter-wave window, employing cooling around its periphery.

In instances involving high energy density beams, such as beams of 100 KW to 1 MW and diameter of 2 to 3 inches, as commonly found in gyrotrons, it may be desirable to cool the window 10. Cooling may be accomplished by cooling around the edges with a cooling jacket 40, as depicted in FIG. 10, or by integrating cooling channels 42 into the interior of the metallic window 10, as depicted in FIG. 11. The former Figure is based on the vacuum embodiment depicted in FIG. 5, while the latter Figure is based on the vacuum embodiment depicted in FIG. 4. However, the method of cooling is not limited to the particular vacuum embodiment nor to any vacuum embodiment at all.

In summary, the present invention is directed to a transparent millimeter-wave metallic window 10. The window 10 consists of a metallic plate 12 perforated by a periodic array 39 of coupling holes 14 and covered by a thin dielectric plate 18. The diameter of the holes 14, the dimensions of the array, and the thickness of the metallic plate 12 and dielectric plate 18 are chosen to yield maximum transmission and minimum reflection at the design frequency. Measurements made using the prototype window validate the metallic window concept.

INDUSTRIAL APPLICABILITY

The transparent metallic millimeter-wave window is expected to find use in a variety of millimeter-wave applications, such as gyrotrons.

What is claimed is:

1. A transparent metallic millimeter-wave window having an operating frequency and comprising a perforated metal plate provided with an array of holes and a dielectric plate secured to the metal plate, the window being transparent at millimeter-wave frequencies.

2. The transparent metallic millimeter-wave window of claim 1 wherein the perforated metal plate comprises a metal selected from the group consisting of copper, beryllium copper alloy, and aluminum.

3. The transparent metallic millimeter-wave window of claim 1 wherein the dielectric plate comprises a dielectric selected from the group consisting of fused quartz, alumina, sapphire, and chemically-vapor-deposited diamond.

4. The transparent metallic millimeter-wave window of claim 1 wherein the operating frequency of the window is determined by the diameter of the holes, periodicity of the array of holes, and thickness of both the perforated metal plate and the dielectric plate.

5. The transparent metallic millimeter-wave window of claim 4 wherein the operating frequency is 95 GHz and the periodicity of the holes is configured such that no grating lobes exist if the holes are arranged in an isosceles triangular pattern and if the following conditions are satisfied:

$$2\frac{\lambda}{d_x} \geq 1+\sin\theta,\ \frac{\lambda}{d_y} \geq 1+\sin\theta,$$

$$\left(\frac{\lambda}{d_x}\right)^2+\left(\frac{\lambda}{2d_y}\right)^2 \geq (1+\sin\theta)^2,$$

where $d_x$ is the distance between holes in the x-direction, $d_y$ is the distance between holes in the y-direction, $\lambda$ is the operating frequency, and $\theta$ is the angle of incidence of the incident field with respect to the direction normal to the surface of the window.

6. The transparent metallic millimeter-wave window of claim 5 wherein the holes are arranged in an isosceles triangle on an x-y coordinate system such that six holes are arranged about a seventh, central hole, with the angle between any two adjacent holes of 60°, with the distance between holes along the x-direction being given by $d_x$, with the distance between holes along the y-direction being given by $d_x \sin\alpha$, where $\alpha$=60°, and with the diameter of each hole being given by a, wherein the window has the following parameters:

$2a$=hole diameter=103±0.25 mils;

$\alpha$=hole offset angle=60°;

$d_x$=hole spacing=123.5±0.5 mils;

$d_y$=vertical hole spacing=$d_x \sin\alpha$=107.0±0.5 mils;

D=plate thickness=250±0.5 mils;

L=dielectric thickness=36±0.25 mils; and $\in_r$=dielectric constant=3.827 (fused silica at 95 GHz).

7. The transparent metallic millimeter-wave window of claim 1 wherein the window is provided with a vacuum seal.

8. The transparent metallic millimeter-wave window of claim 7 wherein the vacuum seal comprises a ceramic-to-metal seal comprising:

a thin-walled copper tube, formed on the perimeter of the plate, to which the ceramic plate is brazed; and a double corset comprising an inner ring of molybdenum and an outer ring of mild steel, the inner ring of molybdenum placed adjacent to the thin-walled copper tube and the outer ring of mild steel having an inside diameter that is slightly smaller than the outer diameter of the molybdenum ring at room temperature so as to place the ceramic-to-metal seal into a controlled amount of compression.

9. The transparent metallic millimeter-wave window of claim 7 wherein the vacuum seal comprises:

a raised rim along the periphery of the metal plate, extending away from the surface of the metal plate;

a molybdenum ring supported by the raised rim and extending toward the surface of the metal plate, the molybdenum ring including a raised inner rim that extends toward the surface of the metal plate, the inner rim terminating in a knife edge; and a fused quartz cup comprising the dielectric plate and a raised rim in which the knife edge portion of the raised inner rim of the molybdenum ring is embedded.

10. The transparent metallic millimeter-wave window of claim 1 wherein the array is periodic across at least a portion of the metal plate.

11. The transparent metallic millimeter-wave window of claim 10 wherein the array is periodic across the entire metal plate.

12. The transparent metallic millimeter-wave window of claim 10 wherein the array of holes is triangular.

13. The transparent metallic millimeter-wave window of claim 1 wherein the perforated metal plate is oriented normal to a beam of millimeter waves.

14. The transparent metallic millimeter-wave window of claim 1 wherein the perforated metal plate is oriented at an angle other than normal to a beam of millimeter waves.

15. The transparent metallic millimeter-wave window of claim 1 provided with a cooling mechanism.

16. The transparent metallic millimeter-wave window of claim 15 wherein the cooling mechanism is around the periphery of the window.

17. The transparent metallic millimeter-wave window of claim 15 wherein the cooling mechanism includes cooling channels incorporated into the interior of the metallic window.

* * * * *